United States Patent [19]

Wasenius

[11] 3,939,792

[45] Feb. 24, 1976

[54] VERTICALLY LIFTABLE RUDDER BLADE

[76] Inventor: Reidar Wasenius, Signalveien 6, 1500 Moss, Norway

[22] Filed: June 25, 1974

[21] Appl. No.: 482,994

[30] Foreign Application Priority Data

June 26, 1973 Norway ..... 2639/73

[52] U.S. Cl. ..... 114/162; 115/18 B

[51] Int. Cl.[2] ..... B63H 25/06

[58] Field of Search ..... 114/162, 164, 165, 167; 115/18 B

[56] References Cited

UNITED STATES PATENTS 3,001,502 9/1961 Stoker ..... 114/167

3,285,219 11/1966 Linsley ..... 115/18 B

*Primary Examiner*—Trygve M. Blix

*Assistant Examiner*—Sherman D. Basinger

*Attorney, Agent, or Firm*—Darby & Darby

[57] ABSTRACT

A rudder for an outboard motor having fins normally located in the slipstream produced by the motor propellor. The force of the water on the fins at a predetermined speed of the boat lifts the rudder vertically so that the steering of the boat is substantially independent of the rudder.

10 Claims, 3 Drawing Figures

VERTICALLY LIFTABLE RUDDER BLADE

The invention concerns a vertically liftable rudder blade preferabely intended for use on vessels equipped with outboard motors and inboard/outboard motor units. The invention is particularly well suited for planing and semi planing vessels which lose their directional stability and steer poorly at low speeds.

In order to increase the directional stability of said types of vessels, there have previously been used rudder blades attached to the submerged parts of the motors or drive units so that the rudder blade is located in the slip stream of the propeller and follows the motion of the submerged parts. The disadvantage of the known constructions is that the rudder force becomes to large at speeds above about 10 knots. Consequently, at high speeds the vessel may become dangerous to steer in that the large rudder force may capsize the vessel even by moderate movement of the steering mechanism. In addition, the vessel will require very large steering effort at high speeds.

The purpose of the invention is to improve the pertinent vessels' directional stability and steering ability at low speeds while avoiding the disadvantages associated with previously known constructions at high speeds. This object is obtained in accordance with the invention in that a rudder blade stays in the slip stream of the propeller only up to a certain speed. Above this speed the rudder blade moves vertically and automatically out of the slip stream so that it has little or no influence on the directional stability and steering ability of the vessel above the predetermined speed. The vertical force required to move the rudder blade is obtained by letting a part of the slip stream of the propeller change direction to act against adjustable wings or planes supported on an axis intersecting a vertical axis through the center of gravity of the rudder blade.

In accordance with the invention extra rudder force will be had only when this necessary, i.e. at low speed. This make the vessel directionally stable and it can run on a straight course, thereby saving fuel, and the pilot does not have to be tense and alert in order to correct the frequent directional changes of the vessel. The rudder blade may also be lifted manually when running in very shallow water. Furthermore, the rudder blade will lift if the vessel should run aground or the like, and this should to a large degree prevent the rudder blade from being damaged. The rudder blade is locked in top position, for instance for preventing the rudder blade from falling down at high speeds when the vessel "skips" from one wave to the next. The desired rudder area in the propeller slip stream can be adjusted by supporting the mechanism distance pieces. This makes it possible to use the same rudder blade for several vessel sizes.

An embodiment of the invention to be taken merely as an example, is shown on the drawings.

Figure 1:
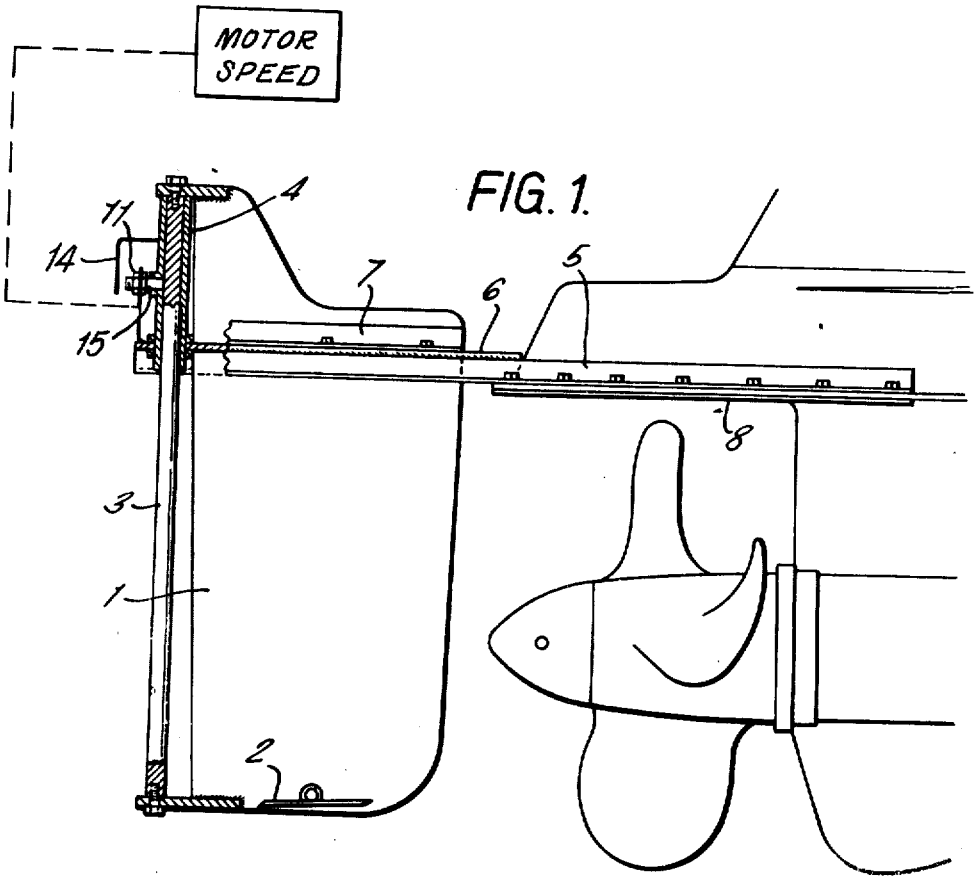
FIG. 1 shows a side view of a rudder according to the invention mounted on the cavitation plate of an outboard drive unit.
Figure 2:
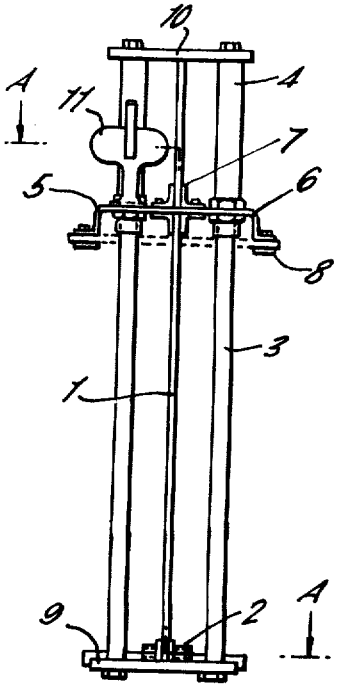
FIG. 2 shows a rear view of a rudder according to the invention where the cavitation plate of the outboard drive unit is shown in broken lines.
Figure 3:
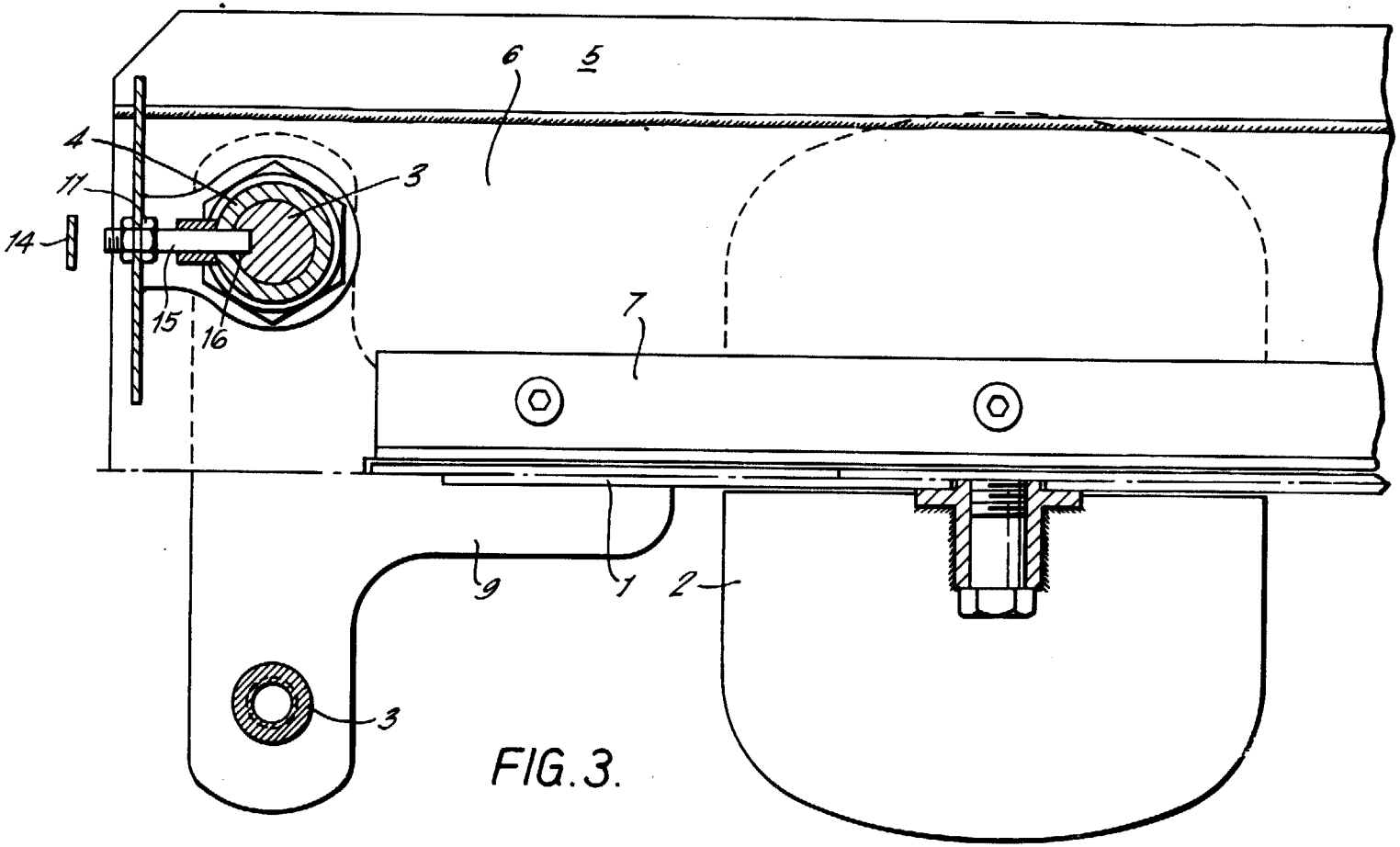
FIG. 3 is section A—A from FIG. 2 where the adjustable planes or wings and the attachment of the steering rods to the rudder blade is shown, together with the mechanism for locking the rudder in the top position.

As shown in the drawings, angle irons 5, a top plate 6 and flat irons 8 form a frame for attachment to the cavitation plate of the outboard drive unit shown. The top plate 6 has a longitudinal slot for the rudder blade 1 which has adjustable planes 2 near its bottom. The rudder blade is guided transversely by the angle irons 7. Furthermore, steering rods 3 moveable in guides 4 will contribute further to guiding the rudder blade both in the direction of travel and sidewise. In operation, a vertical force will be exerted on the adjustable planes 2 due to their inclined orientation with respect to the water stream from the propeller of the outboard drive and this force will under certain conditions lift the rudder blade to the top position. When the vessel has reached a certain speed, the rudder blade is left to a point where it is locked in top position by a cylindrical pin 15 attached to a leaf spring 11 bolted to the top plate 6 moving into a correspondng recess 16 in one of the steering rods 3. This is shown in FIG. 3. The condition for locking is that the vessel has a speed that brings the leaf spring 11 above the water. Releasing of the rudder blade occurs when the speed of the vessel is reduced sufficiently for the water to hit the leaf spring and force it backwards so that the cylindrical pin moves out of engagement with the steering rod 3. The backward motion of the leaf spring is limited by a stop 14 placed on the guide 4 for the correspondng steering rod 3. The resilient locking means 11 also may be released by pulling the leaf spring backwards by a mechanical interconnection with the motor speed adjusting so that the leaf spring can thereby be released in synchronization with motor power. Any suitable mechanism may be used, for example a linkage between the motor throttle and the spring 11. This is shown schematically by a dotted line in FIG. 1. Any other suitable mechanical arrangement can be used, for example, a speed governor controlled system.

Although the invention has been described above in conjunction with a specific embodiment it will be obvious to a person skilled in the art that modifications as to form and materials may be done without departing from the spirit of the invention and the scope of the appended claims.

I claim:

1. The combination comprising a motor for a boat, said motor having a propelling means which produces a slipstream as the boat moves through the water, a rudder for steering the boat at speeds below a predetermined speed, means independent of the boat mechanically coupling the rudder to the motor propelling means so that the rudder is in a position to react to the slipstream produced by the propelling means and both turn together as the boat is steered, and means on said rudder responsive to the movement of the water at said predetermined speed and above lifting the entire rudder up in the water and out of the slipstream when the boat has reached said predetermined speed to make the steering of the boat substantially independent of the rudder.

2. The combination of claim 1 wherein the lifting means lifts the rudder substantially out of the water.

3. The combination of claim 1 wherein said lifting means comprises planes mounted on said rudder.

4. The combination of claim 1 further comprising means for adjusting the position of the planes with respect to the horizontal.

5. The combination of claim 4 wherein said planes are pivotally mounted on said rudder and the pivot axis for the planes intersects the vertical axis through the center of gravity of the rudder.

6. The combination of claim 1 wherein said motor is an outboard drive having a cavitation plate, said means for coupling the rudder to the motor comprising a frame mounted on said cavitation plate, said frame including guide means for holding the rudder in a fixed vertical plane, and means for permitting the rudder to move vertically as it is lifted to move up in the water.

7. The combination of claim 1 further comprising means for locking the rudder in its lifted position.

8. The combination of claim 7 wherein said locking means comprises resilient means having means thereon for engaging said rudder to lock it in its lifted position.

9. The combination of claim 8 wherein said resilient means includes means adapted to be hit by the water to release the engaging means from the rudder.

10. The combination of claim 7 further comprising means responsive to the speed of the motor for releasing the locking means.

* * * * *